US005578800A

United States Patent [19]

Kijima

[11] Patent Number: 5,578,800

[45] Date of Patent: Nov. 26, 1996

[54] MEMBER FOR LOUDSPEAKER

[75] Inventor: Seiji Kijima, Osaka, Japan

[73] Assignee: Nitto Denko Corporation, Osaka, Japan

[21] Appl. No.: 394,257

[22] Filed: Feb. 24, 1995

[30] Foreign Application Priority Data

Feb. 28, 1994 [JP] Japan ..... 6-030237

[51] Int. Cl.$^6$ ..... H04R 7/00

[52] U.S. Cl. ..... 181/171; 181/172

[58] Field of Search ..... 181/171, 172, 181/167, 169

[56] References Cited

U.S. PATENT DOCUMENTS 3,905,448 9/1975 Kawakami et al. ..... 181/172

4,140,203 2/1979 Niguchi et al. ..... 181/170 X 4,429,068 1/1984 Nakahira ..... 524/302

*Primary Examiner*—Khanh Dang

*Attorney, Agent, or Firm*—Sughrue, Mion, Zinn, Macpeak & Seas

[57] ABSTRACT

A loudspeaker member comprising a viscoelastic foam obtained by vulcanization-foaming a viscous rubber mixture comprising the following components (A), (B), (C), and (D), wherein the viscoelastic foam has a tensile strength of from 0.1 to 100 kg/cm$^2$ and a specific gravity of from 0.07 to 1.2;

(A) a rubber, (B) a softening agent, (C) a organic foaming agent, (D) a vulcanizing agent.

10 Claims, 1 Drawing Sheet

MEMBER FOR LOUDSPEAKER

FIELD OF THE INVENTION

The present invention relates to a loudspeaker member which is used as an edge portion, etc., formed at the periphery of a diaphragm of a loudspeaker.

BACKGROUND OF THE INVENTION

Various characteristics that the edge controls the vibration of the diaphragm, the edge itself does not cause an abnormal vibration such as a resonance, etc., and also the edge has an internal loss necessary for decaying an excess vibration of the diaphragm have been required for an edge formed at the peripheral portion of the diaphragm of a loudspeaker to improve the sound characteristics.

Hitherto, for satisfying the requirements, various kinds of edges comprising, for example, the following materials have been developed.

That is, (1) a fiber type edge prepared by impregnating a woven fabric or a nonwoven fabric of natural fibers or synthetic fibers with a thermosetting resin, shaping the fabric by heat-pressing, and finishing by coating it with a damping agent (decaying agent), (2) an urethane compressed type edge prepared by impregnating an urethane foam expanded to about 30 times with a bitumen and shaping the foam by heat-pressing followed by finishing, and (3) a rubber type edge prepared by using a rubber mixture containing a vulcanizing agent and molding it using a predetermined mold followed by finishing.

However, the above-described various kinds of edges each has the following defects.

That is, in the edge of the type (1), the coating work of the damping agent is complicated and the products obtained have a scatter in quality. In the urethane compressed type edge (2), the bitumen oozes out. Further, since the hardness of the molded products is changed by an environmental temperature, a scatter in the tone quality sometimes occurs in the loudspeakers using the products as the edges. Also, the edge has the problem that it is poor in a weather resistance and a water resistance. The rubber type edge (3) described above increases weight of the product itself due to the molded material. Accordingly, the edge cannot follow the vibration of the diaphragm, which results in lowering the sensitivity of the loudspeaker.

As described above, conventional various edges each has the respective problem and hence a loudspeaker member having a high quality, having a good workability, being less influenced by an environmental temperature, and having excellent sound characteristics has been desired.

SUMMARY OF THE INVENTION

The present invention has been made under these circumstances and an object of the present invention is to provide a light-weight loudspeaker member which is not influenced by the environmental conditions such as the environmental temperature, etc., has no scatter in quality, and shows excellent sound characteristics.

As a result of various investigations to attain the object described above, it has been found that the above object can be attained by the present invention described hereinbelow.

According to the present invention, there is provided a loudspeaker member comprising a viscoelastic foam obtained by vulcanization-foaming a viscous rubber mixture comprising the following components (A), (B), (C), and (D), wherein the viscoelastic foam has a tensile strength of from 0.1 to 100 kg/cm$^2$ and a specific gravity of from 0.07 to 1.2;

(A) a rubber, (B) a softening agent, (C) an organic foaming agent, (D) a vulcanizing agent.

That is, the loudspeaker member of the present invention comprises a viscoelastic foam obtained by using a viscous rubber mixture containing the specific components (A) to (D) described above and vulcanization-foaming the mixture such that the resulting viscoelastic foam has specific tensile strength and specific gravity. Thus, the foam matrix which constitutes the loudspeaker member comprises an integral texture of a rubber component and a softening agent component, and the foam matrix has a high strength and is a flexible elastic body. Further, in the loudspeaker member of the present invention, the change of properties influenced by the environmental conditions such as an environmental temperature, etc., is less. Also, the loudspeaker member of the present invention has a small specific gravity and is light weight since the member is a foam although the member is a rubber type. Thus, by using the loudspeaker member of the present invention, excellent sound characteristics can be obtained.

BRIEF DESCRIPTION OF THE DRAWING

The FIGURE is a graph showing the sound characteristics by the loudspeaker prepared by combining the loudspeaker edge produced in Example 1 and a cone paper and the loudspeaker prepared by combining the loudspeaker edge produced in Comparative Example 1 and a cone paper.

DETAILED DESCRIPTION OF THE INVENTION

Figure 1:
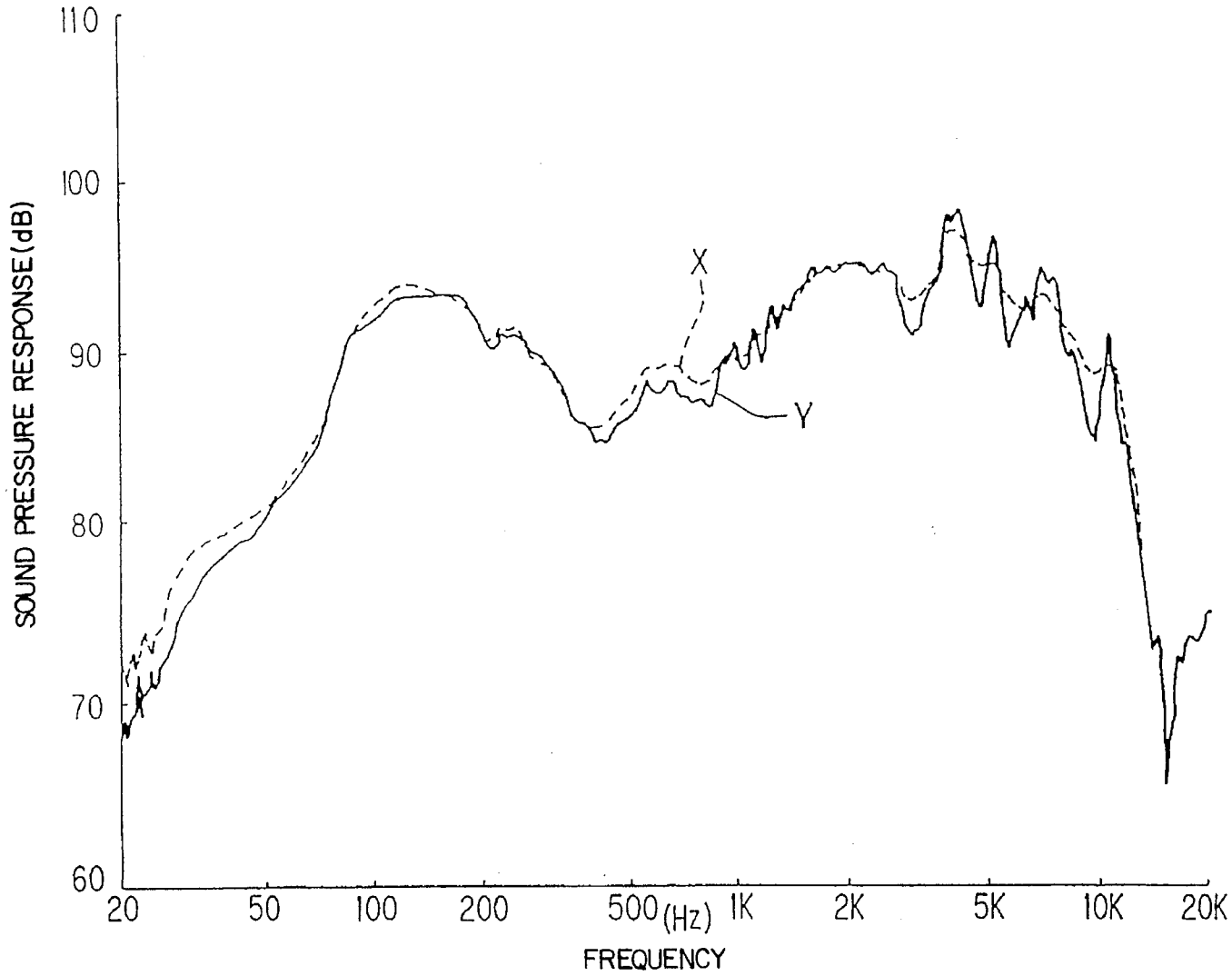

The present invention is described in detail below.

The loudspeaker member of the present invention comprises the specific viscoelastic foam obtained by vulcanization-foaming a viscous rubber mixture comprising a rubber (component A), a softening agent (component B), an organic foaming agent (component C), and a vulcanizing agent (component D).

Examples of the rubber (component A) are synthetic rubbers such as a styrene-butadiene rubber (SBR), a nitrile-butadiene rubber (NBR), and an ethylene-propylene terpolymer rubber (EPT). Furthermore, there are also synthetic rubbers such as an isoprene rubber (IR), a chloroprene rubber (CR), an isobutylene-isoprene rubber (IIR), an ethylene-propylene rubber (EPR), a silicone rubber, etc.

These rubbers can be used alone or as mixtures thereof.

From the point of molding property, a styrene-butadiene rubber (SBR) is particularly preferably used. Furthermore, when a mixture of two or more kinds of the above rubbers is used, a mixture of a nitrile-butadiene rubber (NBR) and an ethylene-propylene terpolymer rubber (EPT) is preferably used from the point of a durability such as a weather resistance, etc.

Examples of the softening agent (component B) which is used together with the component A are petroleum-based softening agents, e.g., plasticizers having a molecular weight of from 300 to 500, such as dioctyl phthalate, dibutyl phthalate, etc.; high molecular weight plasticizers having a molecular weight of from 1,000 to 8,000, such as a polyester plasticizer, etc.; lubricating oils such as a spindle oil, a machine oil, a cylinder oil, etc.; process oils such as a paraffinic process oil, a naphthenic process oil, etc.; and paraffins such as fluid paraffin, vaseline, etc.; coal tar-based softening agents such as coal tar, coal tar pitch, etc.; aliphatic softening agents such as castor oil, cotton seed oil, etc.; waxes such as beeswax, lanolin, etc.; and liquid rubbers such as polybutene, etc.

They can be used alone or as mixtures thereof from the compatibility of each agent with the rubber.

Where the SBR type rubber is used as the component A, the use of, e.g., the naphthenic process oil is particularly preferred. Further, where the NBR type rubber and the EPT type rubber are used as the component A, the use of, e.g., the paraffinic process oil or dioctyl phthalate (DOP) is preferably used from the point of the compatibility therewith.

The compounding ratio of the softening agent (component B) is that the softening agent is compounded in an amount of preferably from 3 to 110 parts by weight, more preferably from 5 to 80 parts by weight, and most preferably from 20 to 60 parts by weight, per 100 parts by weight of the rubber (component A). If the amount of the softening agent is less than 3 parts by weight, the product becomes poor in flexibility, while if the amount thereof is over 110 parts, there is a tendency to cause bleeding on the surface of the product.

Examples of the organic foaming agent (component C) which is used together with the component A and the component B described above are nitroso compounds such as N,N'-dinitrosopentamethylenetetramine, N,N'-dimethyl-N,N'-dinitrosoterephthalamide, etc.; azo compounds such as azodicarbonamide, azobisisobutyronitrile, diazoaminobenzene, etc.; and sulfonylhydrazido compounds such as benzenesulfonylhydrazide, toluenesulfonylhydrazine, etc. Also, other known foaming agents such as p-toluenesulfonylazide, 4,4'-diphenylsulfonylazide, 4,4'-oxybisbenzosulfonylhydrazide, etc., can be used.

They can be used alone or as mixtures thereof. The use of, e.g., azodicarbonamide is particularly preferred from the point of the gas generating amount by heating. Furthermore, where two or more kinds of them are used, the use of, e.g., azodicarbonamide and 4,4'-oxybisbenzenesulfonylhydrazide is preferred from the point of controlling the foam decomposition temperature.

The amount of the organic foaming agent (component C) compounded is preferably from 0.1 to 35 parts by weight, more preferably from 1 to 30 parts by weight, and most preferably from 5 to 20 parts by weight, per 100 parts by weight of the rubber (component A). If the amount of the organic foaming agent is less than 0.1 part by weight, foaming becomes insufficient, while if the amount is over 35 parts by weight, the amount of the foaming agent is too large, and as a result, the gas pressure is larger than a surface layer strength and a foam may not be formed.

Examples of the vulcanizing agent (component D) which is used together with the components A, B and C described above are sulfur compounds such as sulfur, sulfur chloride, sulfur dichloride, etc.; oximes such as p-quinonedioxime, etc.; carbamates such as hexadiamine carbamate, ethylenediamine carbamate, etc.; selenium; litharge, etc. The use of, e.g., sulfur is particularly preferred from the point of quick vulcanization by die molding. When a combination of two or more kinds thereof is used, a combination of sulfur and p-quinonedioxime is preferred.

The amount of the vulcanizing agent (component D) compounded is preferably from 0.01 to 10 parts by weight, and more preferably from 1 to 3 parts by weight, per 100 parts by weight of the rubber (component A). If the amount of the vulcanizing agent is less than 0.01 part by weight, the vulcanization becomes insufficient, while if the amount thereof is over 10 parts by weight, there is a tendency to increase the rubber elasticity.

The viscous rubber mixture which is the material for forming the loudspeaker member of the present invention can further contain properly, if necessary, other additives such as a filler, a rubber reinforcing agent, a vulcanization accelerator, a vulcanization acceleration aid, an ultraviolet absorber, an antioxidant, a foaming aid, etc., in addition to the components A to D described above.

Examples of the filler are inorganic fillers such as calcium carbonate, talc, clay, asbestos, a pumice powder, glass fibers, mica, silica, hollow beads, etc., and organic fillers such as a regenerated rubber, shellac, a wood flour, a cork powder, etc.

They can be used alone or as mixtures thereof. In these fillers, the filler having a uniform particle size and a good dispersibility is preferred to uniformly conduct foaming. Also, from the point of reducing the weight of the loudspeaker member of the present invention, for example, talc or silica is preferably used.

Examples of the rubber reinforcing agent are carbon blacks such as channel black, furnace black, etc., silicas, etc. They can be used alone or as mixtures thereof.

Examples of the vulcanization accelerator are guanidine compounds such as diphenylguanidine, triphenylguanidine, etc.; thiazole compounds such as 2-mercaptobenzothiazole, dibenzothiazole disulfide, etc; thiourea compounds such as thiocabanilide, diethylthiourea, etc.; thiuram compounds such as tetramethylthiuram monosulfide, tetramethylthiuram disulfide, etc.; and dithiocarbamate compounds such as zinc dimethyldithiocarbamate, sodium dimethyldithiocarbamate, etc. They can be used alone or as mixtures thereof.

Examples of the vulcanization acceleration aid are metal oxides such as zinc white, magnesium oxide, etc.; fatty acids such as stearic acid, oleic acid, etc., and the derivatives thereof; cyclohexylamines; dicyclohexylamines, etc. They can be used alone or as mixtures thereof.

Examples of the ultraviolet absorbers are benzophenone compounds, benzotriazole compounds, etc.

Examples of the antioxidants are phenolic compounds, amine ketone compounds, aromatic amine compounds, etc.

Examples of the foaming aid are salicylic acid, urea, etc.

The amounts of the above-described additives compounded are as follows. That is, it is preferred that the amount of the filler is from 10 to 200 parts by weight, the amount of the rubber reinforcing agent is from 10 to 100 parts by weight, the amount of the vulcanizing accelerator is from 0.1 to 20 parts by weight, the amount of the vulcanization acceleration aid is from 0.1 to 10 parts by weight, the amount of the ultraviolet absorber is from 0.1 to 10 parts by weight, the amount of the antioxidant is from 0.1 to 10 parts by weight, and the amount of the foaming aid is from 0.1 to 30 parts by weight, all being per 100 parts by weight of the rubber (component A).

The viscous rubber mixture which is the material for forming the loudspeaker member of the present invention is prepared, for example, as follows. That is, the viscous rubber mixture is prepared by properly compounding the components A to D described above together with, if necessary, other additives followed by kneading. Also, it is preferred that the Mooney viscosity [$ML_{(1+4)}$ 100° C.] of the viscous rubber mixture thus prepared is in the range of from 1 to 30 in producing the viscoelastic foam, and the viscous rubber mixture having a Mooney viscosity of from 2 to 15 is particularly preferred.

In blends for the viscous rubber mixtures, the preferred combination in the blend is a combination that the SBR type rubber is used as the component A, the naphthenic process oil is used as the component B, azodicarbonamide is used as the component C, and sulfur is used as the component D, in the point of molding, followed by substnatially simultaneous vulcanization and foaming, in a short period of time. Furthermore, as other additives in addition to the components A to D as the essential components described above, it is particularly preferred to use talc as the filler, carbon black as the rubber reinforcing agent, tetramethylthiuram disulfide as the vulcanization accelerator, urea as the foaming agent, 2,4-bis[(octylthio)methyl]-o-cresol as the antioxidant, and a hydroxyphenylbenzotriazole derivative as the ultraviolet absorber in addition to zinc white and stearic acid.

The loudspeaker member of the present invention is produced using the viscous rubber mixture, for example, as follows.

That is, first, the viscous rubber mixture is molded into a sheet form (thickness of from 1 to 10 mm) or a film form (thickness of from 0.1 to 1 mm). The molded product is then placed in a mold of a definite form and by vulcanization-foaming the molded product under appropriate heating and pressing conditions, a loudspeaker member which is a viscoelastic foam having a texture wherein the rubber component is integral with the softening agent component is produced. Alternatively, after punching the above sheet-form or film-form molded product into a definite form, the punched product may be heated and pressed in the mold of a definite form. Furthermore, as other method, the viscous rubber mixture may be placed as it is in a mold having a definite form followed by heating and pressing.

The heating and pressing condition of the mold is properly selected according to the kind and the amount of each component which constitutes the viscous rubber mixture but, for example, it is preferred to select the condition that the heat capacity (temperature ×pressure ×time) is a temperature of from 80° to 250° C., a pressure of from 1 to 10 kg/cm$^2$ and a time of from 0.02 to 30 minutes. It is particularly preferred to select the condition that the heat capacity is a temperature of from 150° to 200° C., a pressure of from 4 to 6 kg/cm$^2$ and a time of from 0.5 to 10 minutes.

Further, in the heat-foaming of the viscous rubber mixture, from the relationship with the capacity of the mold, it is preferred to heat-foam the viscous rubber mixture such that the expansion ratio after foaming becomes from 1.05 to 30 times, more preferably from 1.1 to 15 times, and most preferably from 1.5 to 7 times. From the standpoint of the characteristics (sound characteristics, etc.) of the loudspeaker member, it is preferred to foam and vulcanize the viscous rubber mixture by filling the mixture in the mold and heating and pressing it such that the expansion ratio becomes the expansion range described above.

Furthermore, in the loudspeaker member which is the viscoelastic foam obtained, it is preferred to set up a loss tangent to at least 0.001 by properly selecting the composition of the viscous rubber mixture which is the material for forming the loudspeaker member and the foaming and vulcanizing condition by heat-pressing, and it is particularly preferred to set up the loss tangent to at least 0.01. By setting up the loss tangent in the range described above, the sound characteristics are greatly improved and the loudspeaker member sensitively transmitting the vibration of the loudspeaker is obtained.

In addition, the loss tangent is defined as follows.

$$\text{Loss tangent } (\tan\delta)=(E_2)/(E_1)$$

$E_1$: Storage modulus $E_2$: Loss modulus

The loudspeaker member obtained which is the viscoelastic foam must be set up such that the tensile strength is from 0.1 to 100 kg/cm$^2$, and preferably from 5 to 20 kg/cm$^2$. If the tensile strength is less than 0.1 kg/cm$^2$, the strength is insufficient and there is a possibility to cause breaking, while if the tensile strength is over 100 kg/cm$^2$, the strength is too strong to cause vibration.

Further, in the loudspeaker member of the present invention, the specific gravity must be in the range of from 0.07 to 1.2, and preferably from 0.3 to 0.8. If the specific gravity thereof is less than 0.07, the loudspeaker member is broken by a high sound pressure, while if the specific gravity is over 1.2, the loudspeaker member becomes too heavy, whereby the edge does not smoothly vibrate with a sound pressure.

As described above, the loudspeaker member of the present invention comprises a viscoelastic foam obtained by using a viscous rubber mixture containing the specific components (A) to (D) described above and vulcanization-foaming the mixture such that the vulcanized and foamed product has specific tensile strength and specific gravity. Thus, the foamed matrix constituting the loudspeaker member is formed by an integral texture of the rubber component and the softening agent component, whereby the loudspeaker member is light weight and shows a flexible elasticity as compared with conventional loudspeaker members. Accordingly, when the loudspeaker member of the present invention is fixed to a diaphragm (cone paper, etc.), the excess vibration of the diaphragm can be decayed without restraining the vibration of the diaphragm, and thus excellent sound characteristics can be obtained. Furthermore, the change of the properties by the influences of the environmental conditions such as the environmental temperature, etc., is less.

Thus, when the loudspeaker member of the present invention is used as an edge for a loudspeaker, a loudspeaker of high quality having excellent sound characteristics is obtained.

The present invention is explained in more detail by the following examples and comparative examples.

EXAMPLES 1 TO 9, AND COMPARATIVE EXAMPLES 1 AND 2

Each of viscous rubber mixtures was prepared by compounding the components shown in Table 1 below in the proportions also shown in Table 1 below. Each viscous rubber mixture thus prepared was molded into a sheet having a thickness of 2 mm. The sheet was placed in a cavity of a mold for molding a loudspeaker edge, the mold was closed, and the sheet was subjected to foaming and vulcanization under the heating condition of 200° C.×1 minute, thereby obtaining the respective viscoelastic foam. By cutting the notch portion in the periphery of the viscoelastic foam, each loudspeaker edge was obtained.

TABLE 1

| | (parts by weight) | | | | | | | | | | |
|---|---|---|---|---|---|---|---|---|---|---|---|
| | Example | | | | | | | | | Comparative Example | |
| | 1 | 2 | 3 | 4 | 5 | 6 | 7 | 8 | 9 | 1 | 2 |
| Synthetic Rubber | | | | | | | | | | | |
| SBR | 100 | 100 | 100 | 100 | 100 | 100 | 100 | — | — | — | 100 |
| EPT | — | — | — | — | — | — | — | 100 | — | — | — |
| NBR | — | — | — | — | — | — | — | — | 100 | 100 | — |
| Softening Agent | | | | | | | | | | | |
| Naphthenic*1 | 40 | 5 | 100 | 40 | 40 | 40 | 40 | — | — | — | 50 |
| Paraffinic*2 | — | — | — | — | — | — | — | 30 | — | — | — |
| DOP*3 | — | — | — | — | — | — | — | — | 50 | 50 | — |
| Organic Foaming Agent*4 | 10 | 10 | 8 | 5 | 30 | 10 | 20 | 7 | 10 | — | 1 |
| Sulfur | 1.5 | 1.5 | 1.5 | 0.5 | 2.0 | 0.01 | 10 | 2 | 1.5 | 1 | 1 |
| Zinc White | 5 | 5 | 5 | 5 | 5 | 5 | 5 | 5 | 5 | 5 | 5 |
| Stearic Acid | 1 | 1 | 1 | 1 | 1 | 1 | 1 | 1 | 1 | 1 | 1 |
| Filler | | | | | | | | | | | |
| Talc | 40 | 40 | 60 | 30 | 70 | 40 | 40 | — | — | — | 120 |
| $CaCO_3$ | — | — | — | — | — | — | — | 50 | 50 | 50 | — |
| Carbon Black | 50 | 30 | 55 | 60 | 70 | 50 | 50 | 30 | 50 | 50 | 10 |
| Vulcanization Accelerator*5 | 5 | 5 | 5 | 5 | 5 | 10 | 1 | 4 | 5 | 4 | 4 |
| Foaming Aid*6 | 10 | 10 | 10 | 20 | 15 | 10 | 20 | 7 | 10 | — | 1 |
| Antioxidant*7 | 1 | 1 | 1 | 1 | 1 | 1 | 1 | — | 1 | 1 | 1 |
| U.V. Absorber*8 | 1 | 1 | 1 | 1 | 1 | 1 | 1 | — | 1 | 2 | 2 |

*1: Naphthenic process oil
*2: Paraffinic process oil
*3: Dioctyl phthalate
*4: Azodicarbonamide
*5: Tetramethylthiuram disulfide
*6: Urea
*7: 2,4-Bis[(octylthio)methyl]-o-cresol
*8: Hydroxyphenylbenzotriazole derivative The properties [the tensile strength, the specific gravity, the expansion ratio, and the loss tangent (tan δ)] of each of the loudspeaker edges obtained in the examples and the comparative examples were measured according to the following methods. The results obtained are shown in Table 2 below.

Tensile Strength: Measured according to the rubber tensile strength test method of JIS K 6301.

Specific Gravity: Measured according to JIS K 6767.

Expansion Ratio: Calculated by the counter back method from the above specific gravity.

Loss Tangent: Measured by the method of using a kinematic viscoelasticity measuring apparatus (frequency 1 Hz).

As a result of combining the product (specific gravity of 0.4) obtained in Example 1 and a cone paper (tan δ=0.04) having a specific gravity of 0.65 and incorporating the combination into a loudspeaker, the sound characteristics at the loss tangent of tan δ=0.50 were measured. The results obtained are shown in the attached FIGURE.

In the FIGURE, the curve X shows the sound characteristics of the loudspeaker using the product obtained in Example 1 as the edge portion and the curve Y shows the sound characteristics where the product obtained in Comparative Example 1 is used in place of the product obtained in Example 1. The results obtained are also shown in the FIGURE. The measurement of the sound characteristics in

TABLE 2

| | Example | | | | | | | | | Comparative Example | |
|---|---|---|---|---|---|---|---|---|---|---|---|
| | 1 | 2 | 3 | 4 | 5 | 6 | 7 | 8 | 9 | 1 | 2 |
| Tensile Strength ($kg/cm^2$) | 8 | 9 | 7 | 8 | 7 | 7 | 10 | 10 | 9 | 20 | 18 |
| Expansion Ratio (times) | 3 | 3 | 3 | 2.1 | 3.5 | 3.2 | 3 | 2.4 | 2.8 | 1 | 1.1 |
| Specific Gravity | 0.4 | 0.4 | 0.4 | 0.6 | 0.3 | 0.4 | 0.4 | 0.5 | 0.4 | 1.2 | 1.3 |
| Loss Tangent (tan δ)* | 0.50 | 0.42 | 0.45 | 0.46 | 0.41 | 0.44 | 0.40 | 0.45 | 0.48 | 0.11 | 0.12 |

*:Using a cone paper (tan δ = 0.04) of a specific gravity of 0.65, the edge member was attached to the periphery of the cone paper, and the measurement was conducted.

different frequency was carried out by a sound pressure response. As a result, a strain in a high frequency region was small due to the light weight by foaming and also by the characteristics of the rubber elasticity, and good sound characteristics were obtained in a low frequency region. As the result of carrying out the same measurement on other products obtained in other examples, substantially the same good sound characteristics were obtained. On the other hand, the product in Comparative Example 1 was rubber solid without foaming and had a large specific gravity, and it is clear from the FIGURE that a strain is large as compared with the product in Example 1. Also, the product in another comparative example had a small expansion ratio and showed the characteristics almost near solid.

As described above, it can be seen that the product in each example, which is a loudspeaker edge having a small specific gravity obtained by vulcanization-foaming the rubber component as the base, has a light weight and are excellent in the sound characteristics as compared with conventional loudspeaker edges. Further, the product in each example is scarcely influenced by an environmental temperature and does not deteriorate the tone quality, etc. Also, as the result of subjecting each product in the example to an accelerative weather resistance test (500 hours) by a sunshine weather meter and to a deterioration test of loudspeaker edge material by immersing in warm water (168 hours), it can be seen that the product is scarcely changed and is excellent in the weather resistance and the water resistance.

While the invention has been described in detail and with reference to specific embodiments thereof, it will be apparent to one skilled in the art that various changes and modifications can be made therein without departing from the spirit and scope thereof.

What is claimed is:

1. A loudspeaker member comprising a viscoelastic foam obtained by vulcanization-foaming a viscous rubber mixture comprising the following components (A), (B), (C), and (D), wherein the viscoelastic foam has a tensile strength of from 0.1 to 100 kg/cm$^2$ and a specific gravity of from 0.07 to 1.2;

(A) a rubber, (B) a softening agent, (C) an organic foaming agent, (D) a vulcanizing agent.

2. A loudspeaker member of claim 1, wherein the rubber as the component (A) is at least one rubber selected from the group consisting of a styrene-butadiene rubber, a nitrile-butadiene rubber, an ethylene-propylene terpolymer rubber, an isoprene rubber, a chloroprene rubber, an isobutylene-isoprene rubber, an ethylene-propylene rubber, and a silicone rubber.

3. A loudspeaker member of claim 1, wherein the softening agent as the component (B) is at least one softening agent selected from the group consisting of low molecular weight plasticizers, high molecular weight plasticizers, petroleum-based softening agents, coal tar-based softening agents, aliphatic softening agents, waxes, and resins.

4. A loudspeaker member of claim 1, wherein the amount of the softening agent as the component (B) is from 3 to 110 parts by weight per 100 parts by weight of the rubber as the component (A).

5. A loudspeaker member of claim 1, wherein the organic foam as the component (C) is at least one foam selected from the group consisting of nitroso compounds, azo compounds, and sulfonylhydrazide compounds.

6. A loudspeaker member of claim 1, wherein the viscous rubber mixture contains at least one of an inorganic filler and an organic filler, and the amount of the filler is from 10 to 200 parts by weight per 100 parts by weight of the rubber as the component (A).

7. A loudspeaker member of claim 1, wherein the vulcanizing agent as the component (D) is at least one vulcanizing agent selected from the group consisting of sulfur, sulfur compounds, oximes, and carbamates.

8. A loudspeaker member of claim 1, wherein the viscoelastic foam is a foam obtained by foaming and molding the mixture into a thin layer form using a mold.

9. A loudspeaker member of claim 1, wherein the viscoelastic foam has an expansion ratio of from 1.1 to 15 times.

10. A loudspeaker member of claim 1, wherein the viscoelastic foam has a loss tangent of at least 0.001.

* * * * *